US007538291B1

(12) United States Patent
Cheng

(10) Patent No.: US 7,538,291 B1
(45) Date of Patent: May 26, 2009

(54) MICRO SWITCH

(75) Inventor: Yu-Chih Cheng, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 12/060,993

(22) Filed: Apr. 2, 2008

(30) Foreign Application Priority Data

Jan. 10, 2008 (TW) ..... 97101050 A

(51) Int. Cl.
*H01H 3/42* (2006.01)

(52) U.S. Cl. ..... 200/573; 200/468; 200/535

(58) Field of Classification Search ..... 200/573, 200/402, 468, 520–521, 532, 535, 559
See application file for complete search history.

(56) References Cited

U.S. PATENT DOCUMENTS 6,242,706 B1 * 6/2001 Miyata ..... 200/537
6,580,045 B1 * 6/2003 Kuo ..... 200/559
6,917,008 B1 * 7/2005 Ni ..... 200/563
7,202,432 B2 * 4/2007 Nishimura ..... 200/563

* cited by examiner

*Primary Examiner*—Kyung Lee
(74) *Attorney, Agent, or Firm*—Kirton & McConkie; Evan R. Witt

(57) ABSTRACT

A micro switch includes a base, a common terminal, a normally open terminal, a normally close terminal, a top cover, a pressing element, a resilient piece and a cushioning pad. The cushioning pad is disposed on an inner surface of the top cover. By means of the cushioning pad, the noise generated during operation of the micro switch is minimized.

7 Claims, 2 Drawing Sheets

MICRO SWITCH

FIELD OF THE INVENTION

The present invention relates to a micro switch, and more particularly to a micro switch with reduced noise.

BACKGROUND OF THE INVENTION

Due to the amazing power of computer systems, computer systems become essential data processing apparatuses in the digitalized and electronic societies. Input devices such as mouse devices have been widely employed in a computer system for cursor control. Via the mouse device, the user may communicate with the computer system. Nowadays, with increasing demand of using the mouse device, the mouse devices having a variety of functions and hardware configurations are designed and the associated technologies are well established in order to meet the users' requirements.

Conventionally, the mechanical mouse device or the optical mouse device has a left click button and a right click button. By clicking the left click button and the right click button, corresponding micro switches under these click buttons are triggered to issue corresponding control commands. As known, when the left click button or the right click button is clicked, a loud noise is generated from the corresponding micro switch. In a case that many people in a conference room are using mouse devices, the noisy sounds emitted from the micro switches may bother the attendants.

The detailed structure will be illustrated as follows with reference to FIG. 1A and FIG. 1B. FIG. 1A is a schematic side view of a conventional micro switch. FIG. 1B is a schematic cutaway view of the conventional micro switch. The micro switch 100 principally includes a base 101, a pressing element 109 and a top cover 102. A perforation 103 is formed in the top cover 102. The micro switch 100 further includes a common terminal 105, a normally open terminal 106, a normally close terminal 104 and a resilient piece 107. The common terminal 105 is disposed on an edge of the base 101. The normally open terminal 106 is disposed on another edge of the base 101. The normally close terminal 104 is disposed beside the normally open terminal 106. The resilient piece 107 has a first end arranged on the common terminal 105 and a salient 108 is formed on a second end of the resilient piece 107. In a case that the no external force is exerted on the resilient piece 107, the salient 108 at the second end of the resilient piece 107 is contacted with the normally close terminal 104. Moreover, the pressing element 109 includes a button portion 110 and a protrusion edge 111. The button portion 110 of the pressing element 109 penetrates through the perforation 103 of the top cover 102, and the protrusion edge 111 adjacent to the button portion 110 is in contact with the periphery of the perforation 103 of the top cover 102 to prevent the pressing element 109 from gliding out of the perforation 103.

The micro switch 100 is actuated to generate a switching signal by rendering mutual touch between the resilient piece 107, the common terminal 105, the normally open terminal 106 and the normally close terminal 104. In a case that the no external force is exerted on the resilient piece 107, the salient 108 at the second end of the resilient piece 107 is contacted with the normally close terminal 104. Whereas, if the pressing element 109 is pressed down to have the salient 108 of the resilient piece 107 separate from the normally close terminal 104 and have the resilient piece 107 come to contact with the normally open terminal 106, a loop is defined by the common terminal 105, the resilient piece 107 and the normally open terminal 106. Meanwhile, a conducting signal is asserted from the micro switch 100. When the external force is eliminated, the resilient piece 107 returns to its original position and the salient 108 at the second end thereof will come to contact with the normally close terminal 104 again.

As previously described, if the pressing element 109 is pressed down to have the resilient piece 107 come to contact with the normally open terminal 106, a loop is defined and a conducting signal is generated. When the external force is eliminated, the restoring force of the resilient piece 107 may push back the pressing element 109 to its original position. During the resilient piece 107 returns to the original position, the salient 108 on the resilient piece 107 may collide with the normally close terminal 104. Since the salient 108 and the normally close terminal 104 are collided with each other during operation of the micro switch 100, loud noise is readily generated.

Therefore, there is a need of providing a micro switch with reduced noise to obviate the drawbacks encountered from the prior art.

SUMMARY OF THE INVENTION

It is an object of the present invention to provide a micro switch with reduced noise during operation.

In accordance with an aspect of the present invention, there is provided a micro switch. The micro switch includes a base, a common terminal, a normally open terminal, a normally close terminal, a top cover, a pressing element, a resilient piece and a cushioning pad. The common terminal is disposed on an edge of the base. The normally open terminal is disposed on another edge of the base. The normally close terminal is disposed beside the normally open terminal. The top cover includes an upper surface and a perforation, wherein the base is sheltered by the top cover. The pressing element partially penetrates through the perforation and is protruded from the upper surface of the top cover. The resilient piece has a first end in contact with the common terminal and a second end with a salient. The salient of the resilient piece is contacted with the normally open terminal when the pressing element is pressed down to suppress the resilient piece. The cushioning pad is disposed on an inner surface of the top cover.

In an embodiment, the top cover further includes two ribs, which are arranged on the inner surface and perpendicular to the upper surface of the top cover, for fixing the cushioning pad therebetween. If the resilient piece is not suppressed by the pressing element, the cushioning pad is contacted with the resilient piece but not contacted with the two ribs.

Preferably, the cushioning pad is made of foaming rubber, flexible silicone, sponge, Ethylene-Vinyl Acetate copolymer (EVA) or thermoplastic rubber (TPR).

In an embodiment, the pressing element includes a button portion and a protrusion edge. The protrusion edge is disposed on the periphery of the button portion and in contact with the periphery of the perforation.

Preferably, the protrusion edge of the pressing element is made of vibration absorbing material.

Preferably, the vibration absorbing material is selected from rubber, silicone or thermoplastic rubber (TPR).

In an embodiment, the common terminal, the normally open terminal, the normally close terminal, the resilient piece and the salient are made of metallic materials.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1A:
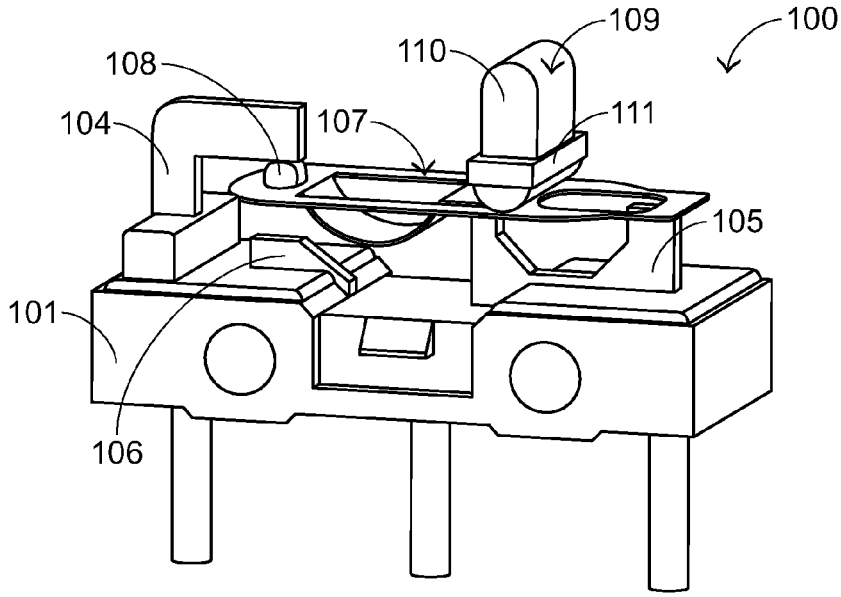
FIG.1A PRIOR ART
FIG. 1A is a schematic side view of a conventional micro switch.
Figure 1B:
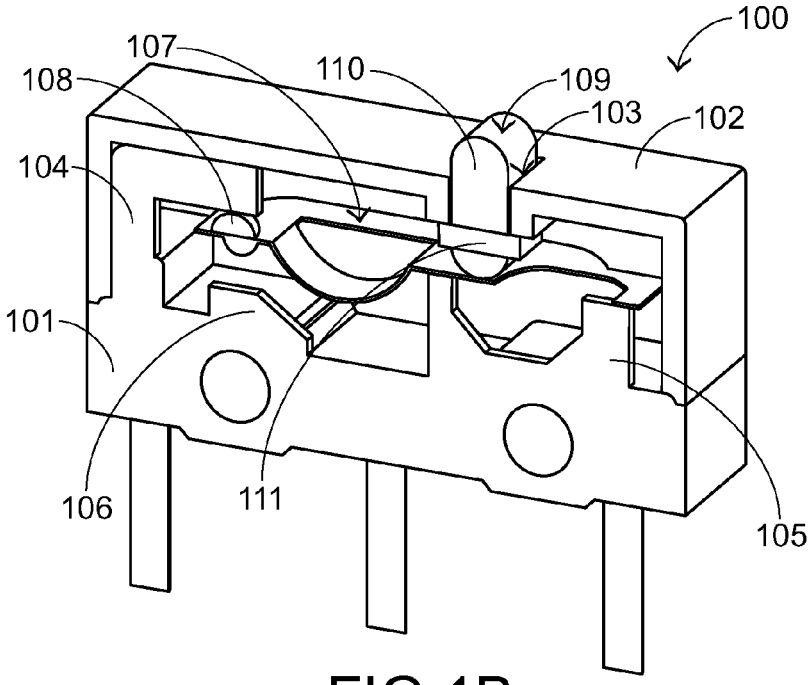
FIG.1B PRIOR ART
FIG. 1B is a schematic cutaway view of the conventional micro switch.

As previously described in the prior art, when the salient and the normally close terminal are collided with each other, loud noise is readily generated. For obviating the drawbacks encountered from the prior art, the present invention relates to a micro switch with reduced noise during operation.

It is found that metallic noise is also generated in the conventional micro switch 100 when the pressing element 109 is pressed down to have the resilient piece 107 come to contact with the normally open terminal 106. When the external force is eliminated, the resilient piece 107 returns to its original position and the salient 108 and the normally close terminal 104 are collided with each other to generate louder noise. Since louder noise is generated when the salient and the normally close terminal are collided with each other, the inventor of the present invention has made efforts to reduce noise resulted from contact between the salient and the normally close terminal.

Figure 2A:
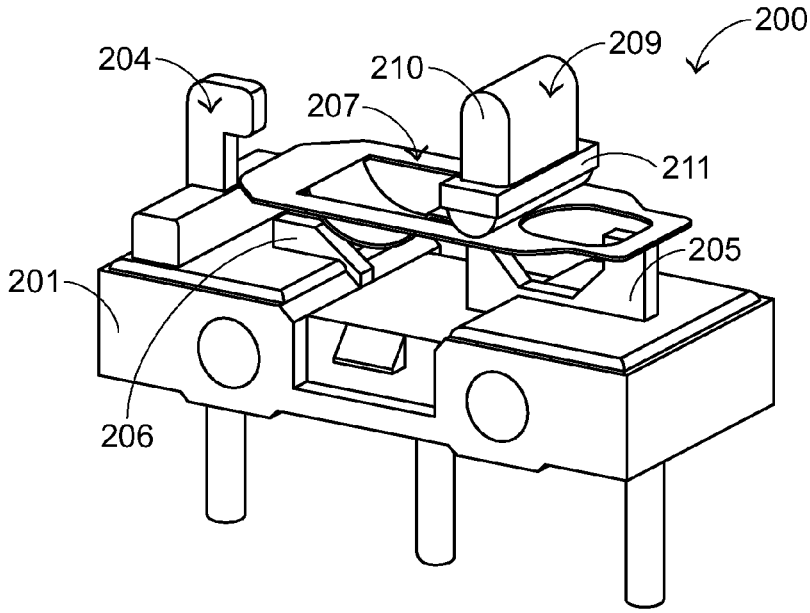
FIG. 2A is a schematic side view illustrating a micro switch of the present invention.
Figure 2B:
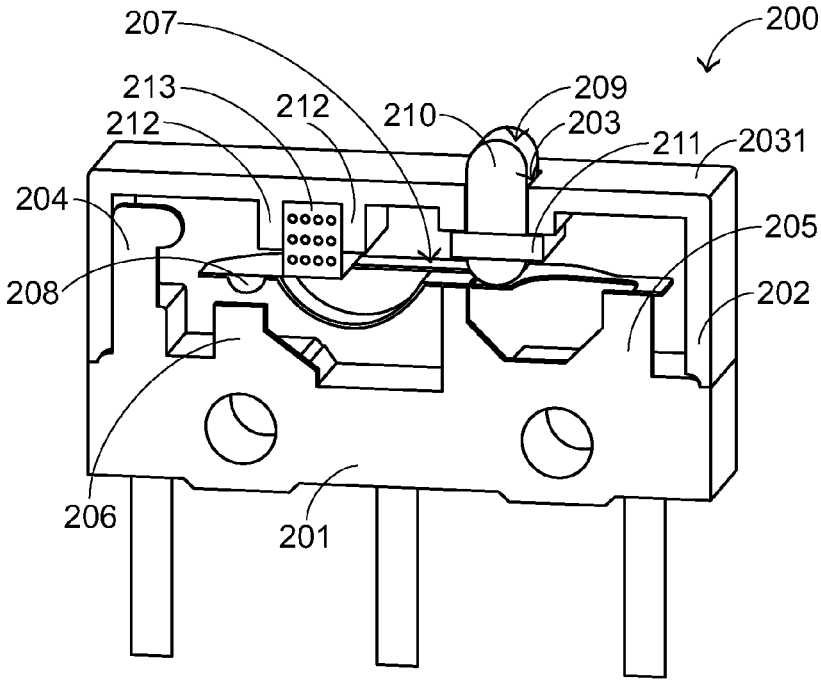
FIG. 2B is a schematic cutaway view illustrating the micro switch of the present invention.

Hereinafter, the detailed structure of a micro switch according to a preferred embodiment of the present invention will be illustrated with reference to FIG. 2A and FIG. 2B. FIG. 2A is a schematic side view illustrating a micro switch of the present invention. FIG. 2B is a schematic cutaway view illustrating the micro switch of the present invention. The micro switch 200 principally includes a base 201, a top cover 202 and a pressing element 209. A perforation 203 is formed in the top cover 202. The top cover 202 further includes an upper surface 2031 and two ribs 212. These two ribs 212 are perpendicular to the upper surface 2031 of the top cover 202 and protruded from the inner surface of the top cover 202. The pressing element 209 penetrates through the perforation 203 of the top cover 202 to be manipulated by a user. The pressing element 209 includes a button portion 210 and a protrusion edge 211. After button portion 210 of the pressing element 209 penetrates through the perforation 203 of the top cover 202 and protruded from the upper surface 2031 of the top cover 202, the protrusion edge 211 adjacent to the button portion 210 is in contact with the periphery of the perforation 203 of the top cover 202 to prevent the pressing element 209 from gliding out of the perforation 203.

The micro switch 200 further includes a normally close terminal 204, a common terminal 205, a normally open terminal 206 and a resilient piece 207, which are all disposed on the base 201. The common terminal 205 is disposed on an edge of the base 201. The normally open terminal 206 is disposed on another edge of the base 201. The normally close terminal 204 is disposed beside the normally open terminal 206. The resilient piece 207 has a first end in contact with common terminal 205. In response to a downward external force exerted on the pressing element 209, the second end of the resilient piece 207 is contacted with the normally open terminal 206. When the downward external force is eliminated, the second end of the resilient piece 207 is swung toward the normally close terminal 204 but is not contacted with the normally close terminal 204. A salient 208 is formed on a second end of the resilient piece 207 and faces to the normally open terminal 206. In a case that salient 208 of the resilient piece 207 is contacted with the normally open terminal 206, a loop is defined by the common terminal 205, the resilient piece 207 and the normally open terminal 206.

For a purpose of minimizing the noise generated when the resilient piece 207 is contacted with the normally close terminal 204, a cushioning pad 213 is arranged between the two ribs 212 on the inner surface of the top cover 202. The cushioning pad 213 is fixed between the two ribs 212 without moving within the top cover 202. Moreover, the thickness of the cushioning pad 213 is greater than the length of the rib 212. As a consequence, when the second end of the resilient piece 207 is swung upwardly, the resilient piece 207 is contacted with the cushioning pad 213 but not contacted with the ribs 212. As shown in FIG. 2B, the cushioning pad 213 is made of vibration absorbing material such as foaming rubber, flexible silicone, sponge, Ethylene-Vinyl Acetate copolymer (EVA) or thermoplastic rubber (TPR). Since the cushioning pad 213 is made of vibration absorbing material, tiny or no noise is generated when the resilient piece 207 is contacted with the cushioning pad 213.

For preventing direct contact between the resilient piece 207 and the normally close terminal 204 when the second end of the resilient piece 207 is swung upwardly, the structure of normally close terminal 204 of the micro switch 200 is modified. In accordance with a key feature of the present invention, the normally close terminal 204 is shortened such that the second end of the resilient piece 207 is not contacted with the normally close terminal 204 within the swing range of the resilient piece 207, as can be seen in FIG. 2B. It is noted that only the common terminal 205 and the normally open terminal 206 of the micro switch 200 participate in the actions of clicking the click buttons. That is, even if the normally close terminal 204 is not responsible of participating in the actions of clicking the click buttons, the operation of the micro switch 200 is feasible.

For further minimizing the noise upon operating the micro switch, it is preferred that the protrusion edge 211 of the pressing element 209 is made of vibration absorbing material such as foaming rubber, silicone or thermoplastic rubber (TPR). The periphery of the perforation 203 of the top cover 202 which is in contact with the protrusion edge 211 is made of plastic material. Since the button portion 210 of the pressing element 209 penetrates through the perforation 203 of the top cover 202, the protrusion edge 211 and the periphery of the perforation 203 are collided with each other during operation of the micro switch 200. In this embodiment, since the protrusion edge 211 is made of vibration absorbing material, the vibration impact on the protrusion edge 211 is absorbed by the protrusion edge 211. The vibration absorbing material of the protrusion edge 211 is flexible and thus the noise generated when the protrusion edge 211 collides with the periphery of the perforation 203 is minimized. Moreover, the pressing element 209 excluding the protrusion edge 211 is made of different material from the vibration absorbing material. Via a double injection process for example, the pressing element 209 is integrally formed.

The vibration absorbing material is not restricted to foaming rubber, flexible silicone, sponge, EVA or TPR as long as the vibration impact on the protrusion edge of the pressing element or the colliding portion and the generated noise are reduced.

In a preferred embodiment of the present invention, the cushioning pad is adhered onto the inner surface of the top cover. For securely fixing the cushioning pad, the ribs can be replaced with an opening in the top cover of the micro switch. Under this circumstance, the upper end of the cushioning pad is designed to have a shape engageable with the opening. After the cushioning pad is plugged into the opening, the cushioning pad is securely fixed in the top cover. Optionally, for preventing from exposing the opening, a lid can be disposed on the top cover to shield the opening. Since the operating principles of this embodiment are identical to those shown in FIG. 2 except for the arrangement of the cushioning pad, and are not redundantly described herein.

From the above description, it is found that noise is only generated when the resilient piece is contacted with the normally open terminal according to the present invention. Since the resilient piece is no longer contacted with the components other than the normally open terminal, the noise generated upon operation of the micro switch is largely reduced when compared with the conventional micro switch.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A micro switch comprising:

a base;

a common terminal disposed on an edge of said base;

a normally open terminal disposed on another edge of said base;

a normally close terminal disposed beside said normally open terminal;

a top cover including an upper surface and a perforation, wherein said base is sheltered by said top cover;

a pressing element partially penetrating through said perforation and protruded from said upper surface of said top cover;

a resilient piece having a first end in contact with said common terminal and a second end with a salient, wherein said salient of said resilient piece is contacted with said normally open terminal when said pressing element is pressed down to suppress said resilient piece; and a cushioning pad disposed on an inner surface of said top cover.

2. The micro switch according to claim 1 wherein said top cover further includes two ribs, which are arranged on said inner surface and perpendicular to said upper surface of said top cover, for fixing said cushioning pad therebetween, wherein said cushioning pad is contacted with said resilient piece but not contacted with said two ribs if said resilient piece is not suppressed by said pressing element.

3. The micro switch according to claim 2 wherein said cushioning pad is made of foaming rubber, flexible silicone, sponge, Ethylene-Vinyl Acetate copolymer (EVA) or thermoplastic rubber (TPR).

4. The micro switch according to claim 1 wherein said pressing element includes:

a button portion; and a protrusion edge disposed on the periphery of said button portion and in contact with the periphery of said perforation.

5. The micro switch according to claim 4 wherein said protrusion edge of said pressing element is made of vibration absorbing material.

6. The micro switch according to claim 5 wherein said vibration absorbing material is selected from rubber, silicone or thermoplastic rubber (TPR).

7. The micro switch according to claim 1 wherein said common terminal, said normally open terminal, said normally close terminal, said resilient piece and said salient are made of metallic materials.

* * * * *